US006522115B1

(12) United States Patent
Greitschus

(10) Patent No.: US 6,522,115 B1
(45) **Date of Patent: *Feb. 18, 2003**

(54) PULSE-WIDTH-MODULATED DC-DC CONVERTER WITH A RAMP GENERATOR

(75) Inventor: Norbert Greitschus, Endingen (DE)

(73) Assignee: Micronas GmbH, Freiburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/370,271

(22) Filed: Aug. 9, 1999

(30) Foreign Application Priority Data

Aug. 17, 1998 (DE) ..... 198 37 153

(51) Int. Cl.[7] ..... G05F 1/40

(52) U.S. Cl. ..... 323/288; 323/283; 323/284; 323/222

(58) Field of Search ..... 327/140, 137; 323/288, 283, 284, 222

(56) References Cited

U.S. PATENT DOCUMENTS 4,546,421 A * 10/1985 Bello et al. ..... 363/21
5,469,029 A * 11/1995 Jackson et al. ..... 315/408
5,982,156 A * 11/1999 Weimer et al. ..... 323/222
6,011,706 A * 1/2000 Adragna et al. ..... 363/41

FOREIGN PATENT DOCUMENTS

DE 91 17 264 U1 1/1998
EP 0 498 553 A2 1/1992
JP 3-234442 7/1993

OTHER PUBLICATIONS

Regan Zane and Dragan Maksimovic; Nonlinear–Carrier Control for High–Power–Factor Rectifiers Based on Up–Down Switching Converters, IEEE Transactions on Power Electronics, vol. 13, No. 2, Mar. 1998 pp. 213–221.
Luigi Calderone, Lician Pinola and Vincenzo Varoli; Optimal Feed–Forward Compensation for PWM DC/DC Converters with "Linear" and "Quadratic" Conversion Ratio, IEEE Transactions on Power Electronics, vol. 7, No. 2, Apr. 1992 pp. 349–355.
Fakhralden A. Huliehel, Wei Tang, Fred C. Lee and Bo H. Cho; Modeling, Analysis, and Design of the Quasi–Charge Control, IEEE Transactions on Power Electronics, vol. 10, No. 5, Sep. 1995, pp. 597–604.
Wei Tang, Fred C. Lee, Raymond B. Ridley and Isaac Cohen, Charge Control: Modeling, Analysis, and Design, IEEE Transaction on Power Electronics, vol. 8, No. 4, Oct. 1993 pp. 396–403.

* cited by examiner

*Primary Examiner*—Shawn Riley
(74) *Attorney, Agent, or Firm*—Samuels, Gauthier & Stevens, LLP

(57) ABSTRACT

A pulse-width-modulated DC-DC converter provides an output signal that is feedback to an error amplifier. The converter includes a comparator for comparing the output voltage of the error amplifier with the output voltage of a compensated ramp generator and having its output coupled to a switching transistor. The compensated ramp generator is designed so that the signal proportional to the current ($I_{Drossel}$) through an inductor is superimposed on the ramp voltage so as to generate an output voltage having a saw-tooth waveform with a concave rise.

5 Claims, 3 Drawing Sheets

PULSE-WIDTH-MODULATED DC-DC CONVERTER WITH A RAMP GENERATOR

BACKGROUND OF THE INVENTION

This invention relates to DC-DC converters, and in particular to a pulse-width modulated (PWM) DC-DC converter.

PWM DC-DC converters are widely used, see for example Maxim data sheet MAX 731/MAX 752, 19-4672; Rev 2; dated February, 1993. To generate a constant output voltage, the output voltage is fed back through a voltage divider, compared with a ramp voltage from a ramp generator via an error amplifier and the comparator, and applied to a switching transistor to adjust the duty cycle for the constant output voltage. Connected between the comparator and the switching transistor is a flip-flop to which the clock frequency of a clock is applied for activating the switching transistor.

The stability limit of the feedback DC-DC voltage converter is a function of the current through an inductor and the inverse of the input voltage. The inductor current is a function of the load current and the input voltage. The loop gain is influenced by the inductor current and the inverse of the input voltage. It increases with increasing inductor current, whereas the poles of the system, i.e., the phase shifts of the loop gain, remain unchanged. This results in a reduction of the phase margin and thus produces instability.

To compensate for this effect, capacitors are connected in parallel with the voltage divider which influence the frequency response in such a way that sufficient stability is achieved for a particular range of load currents and of the input voltage. Since the poles, which are determined by the smoothing capacitor and the inductor, are located at very low frequencies, very large compensation capacitors are necessary. These are not suitable for monolithic integration.

Another measure to stabilize the DC-DC converter is to add a voltage proportional to the inductor current to the ramp voltage from the ramp generator with an adder. Use is made of a voltage proportional to the current through the switching transistor. Thus, at high inductor currents, the comparator switches earlier, so that the on time of the switching transistor and the loop gain are reduced. This compensation has the disadvantage that an additional, accurate adder is needed to compensate the ramp generator. Another disadvantage is that at a high inductor current, the loop gain is reduced already at the beginning of the turn-on cycle. As a result, the gain is also reduced at high input voltages, which adversely affects the accuracy of the output voltage.

SUMMARY OF THE INVENTION

An object of the invention is to provide an improved pulse-width-modulated DC-DC converter.

Briefly, according to the present invention, a PWM DC-DC converter comprises a series combination of a switching transistor and an inductor, with the switching transistor shunted by a smoothing capacitor in series with a switching element, so that an input voltage applied to the series combination of the switching transistor and the inductor is converted into a higher output voltage appearing across the smoothing capacitor; an error amplifier having its first input connected to a voltage divider, to which the output voltage can be applied, and having its second input connected to a reference voltage source; and a comparator having its first and second inputs connected, respectively, to the output of the error amplifier and to a ramp generator compensated a signal proportional to the current through the inductor, and having its output coupled to the gate electrode of the switching transistor. The compensated ramp generator provides an output voltage having a sawtooth waveform with a concave voltage, wherein the signal proportional to the current through the inductor is superimposable on the ramp voltage.

Through the concave rise of the ramp voltage generated by the compensated ramp generator, a higher slew rate of the ramp voltage is attained. As a result, the gain of the feedback DC-DC converter is reduced only at high inductor currents and low input voltages. Consequently, the frequency response of the DC-DC converter can be held constant despite changes in operating conditions, particularly despite changes in input voltage and load current. A smaller loop gain at high input voltages, and thus a loss of accuracy of the output voltage of the DC-DC converter, is prevented.

In one preferred embodiment of the invention, the ramp generator is designed so that the sum of a correction current, which is proportional to the inductor current, and a constant reference current is integrable in the ramp generator, so that the output voltage of the ramp generator rises quadratically. By this design of the ramp generator, a frequency response of the DC-DC converter independent of the operating conditions is achieved in a simple manner. It is not necessary to use a device occupying a large area, such as an accurate adder.

In another preferred embodiment of the invention, the integration of the sum of the correction current and the constant reference current is accomplished by supplying the correction current and the constant reference current to a capacitor which can be discharged by a parallel-connected switching element at the frequency of the signal applied to the gate electrode of the switching transistor. A quadratic rise of the ramp voltage is thus obtained in a simple manner.

To generate the correction current, a first amplifier may advantageously be provided, to whose input a voltage proportional to the inductor current can be applied, and whose output is connected through a resistor to a first node of constant potential, to which the correction current can be supplied. For the amplifier, a unity-gain buffer can be used. It can be implemented with a feedback operational amplifier. The operational amplifier may have an output stage that includes a first reference current source in series with a first transistor connected in common-source configuration.

To generate the constant node potential in the first node, a second operational amplifier may be provided. The first input of the second operational amplifier is connected to a first constant reference voltage source, and the second input is connected to the first node. The first node makes the constant node potential available over a low-resistivity path and is connected to the output of the second operational amplifier. The output stage of the second operational amplifier may include a second reference current source in series with a second transistor connected in common-source configuration. Thus, the sum of the correction current and the constant reference current can flow into the node.

In yet another preferred embodiment of the invention, a current mirror is provided which mirrors the sum of the correction current and the constant reference current produced at the node onto the capacitor. The current mirror can be formed from the first and second operational amplifiers and a third transistor connected in common-source configuration. The gate of the third transistor is connected to the gate of the first transistor, and the drain of the third transistor is connected to the capacitor. In another embodiment, the gate of the third transistor is connected to the gate of the second transistor, and the drain of the third transistor is connected to the capacitor via a second current mirror.

The first transistor and the second transistor may have a fixed relationship to each other in terms of their electrical characteristics. In the case of MOSFET transistors, this is achieved by fixed W/L (width/length) ratios of the transistors. With the first and second reference current sources, currents having a fixed relationship to each other may be generable. If the reference current sources generate equal currents, and the first and second transistors have the same electrical characteristics, equal conditions exist in the circuit, so that a good match of the individual circuit elements is obtained, whereby electrical influences and influences of temperature or of mask alignment errors are avoided.

The signal proportional to the inductor current can be determined from the voltage drop across the switching transistor. This is possible since the switching transistor is operated in the triode region, so that it behaves as a resistor. Methods of determining the inductor current are known from the prior art, for example from German patent application P 198 12 299.3. Advantageously, the circuit is implemented using monolithic integrated circuit technology.

These and other objects, features and advantages of the present invention will become apparent in light of the following detailed description of preferred embodiments thereof, as illustrated in the accompanying drawings.

DETAILED DESCRIPTION OF THE INVENTION

Figure 1:
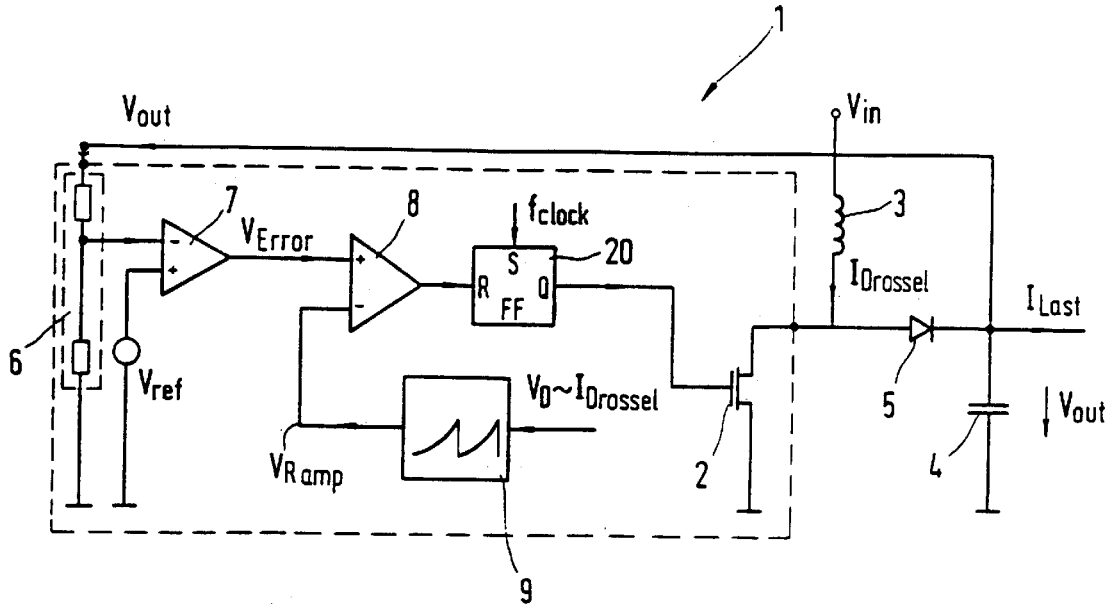
FIG. 1 is a schematic circuit diagram of a pulse-width-modulated DC-DC converter in accordance with the invention.

FIG. 1 is a schematic illustration of a pulse-width modulated (PWM) DC-DC converter 1 according to the invention. The DC-DC converter 1 comprises a series combination of a switching transistor 2 and a inductor 3. Connected in parallel with the switching transistor 2 is a smoothing capacitor 4 in series with a switching element 5. With the DC-DC converter 1, an input voltage $V_{in}$ applied to the series combination of the switching transistor 2 and the inductor 3 is converted into a higher output voltage $V_{out}$, which appears across the smoothing capacitor 4. The output voltage $V_{out}$ is fed back to the DC-DC converter 1 via a voltage divider 6, which includes two resistors. An error amplifier 7 is provided which has its first and second inputs connected to the voltage divider 6 and a reference voltage source $V_{ref}$, respectively. A comparator 8 has its first input connected to the output of the error amplifier 7; its second input is connected to a ramp generator 9, which is compensated by means of a signal proportional to the current $I_{Drossel}$ through the inductor 3, and the output of the comparator 8 is coupled to the gate of the switching transistor 2. The compensated ramp generator 9 is designed to generate an output voltage having a sawtooth waveform with a concave rise. This voltage waveform is obtained by superimposing the ramp voltage from the ramp generator 9 on the signal proportional to the current through the inductor 3.

The output of the comparator 8 is connected through a flip-flop 20 to the gate of the switching transistor 2. The flip-flop 20 is controlled with a signal of frequency $f_{clock}$ from a clock. It is an R-S (reset-set) flip-flop with a reset input R, a set input S, and an active output Q, which is connected to the gate of the switching transistor 2. The frequency $f_{clock}$ of the signal from the clock is adapted to the frequency of the signal from the ramp generator 9. The output signal of the comparator 8 determines the frequency for switching the switching transistor 2.

Through the feedback provided around the pulse-width-modulated DC-DC converter, the duty cycle of the switching transistor is adjusted, whereby the output voltage $V_{out}$ is regulated. At an excessive output voltage $V_{out}$, the output voltage $V_{error}$ of the error amplifier is reduced. This reduces the on time $T_E$ of the switching transistor and, thus, the output voltage $V_{out}$ of the DC-DC converter.

Figure 2:
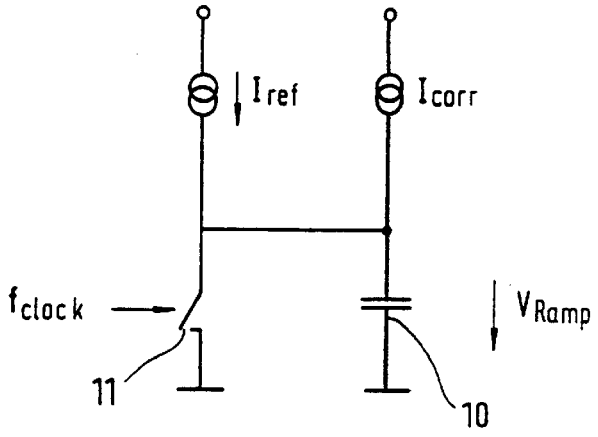
FIG. 2 is a schematic circuit diagram of a compensated ramp generator in accordance with the invention.

FIG. 2 illustrates the basic operation of the compensated ramp generator 9. A capacitor 10 receives the sum of the correction current $I_{corr}$ and the constant reference current $I_{ref}$ is fed. Connected in parallel with the capacitor 10 is a switching element 11 by which the capacitor 10 can be discharged at the frequency of the signal applied to the gate of the switching transistor 2.

Figure 3A:
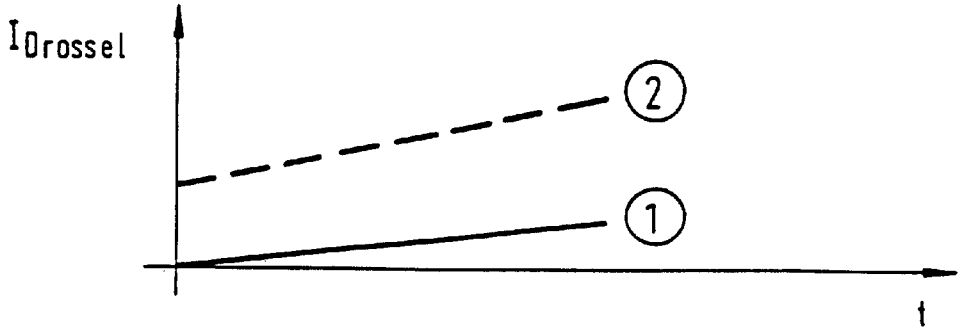
FIGS. 3*a* and 3*b* are plots of inductor current as a function of time and voltage of the ramp generator of FIG. 2 as a function of time, respectively.
Figure 3B:
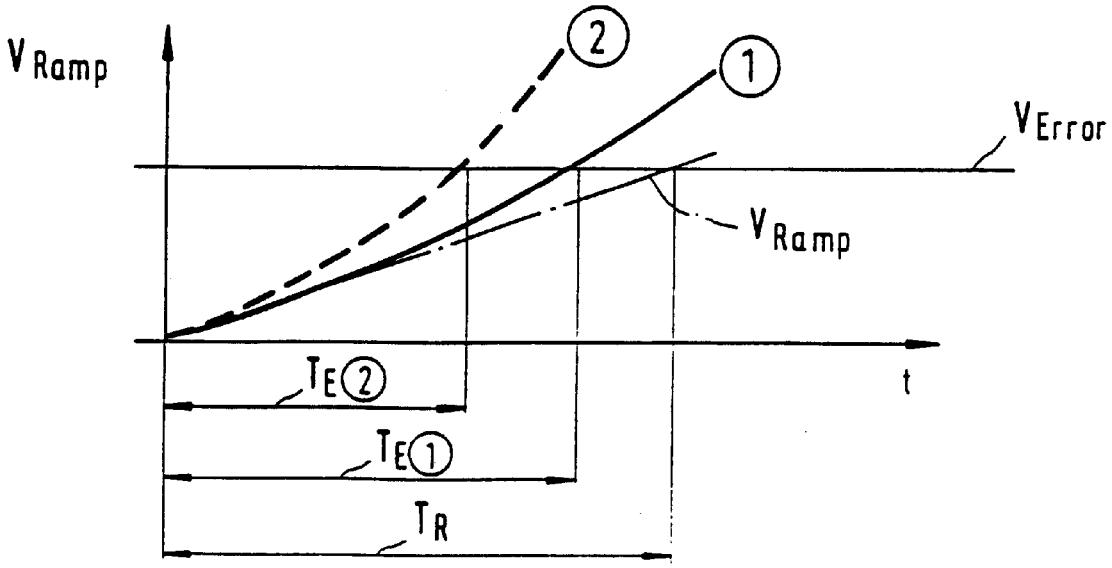

FIG. 3*a* is a plot of inductor current $I_{Drossel}$, to which the correction current $I_{corr}$ is proportional, as a function of time. The characteristic for a low inductor current is designated 1, and that for a high inductor current is designated 2. FIG. 3*b* shows the output voltage of the ramp generator $V_{Ramp}$ for the two current characteristics 1 and 2 of FIG. 3*a*. The voltage waveform is parabolic, so that the zero of the output voltage of the ramp generator $V_{Ramp}$ remains unchanged. Also shown is the output voltage $V_{Error}$ of the error amplifier as a function of time. With the comparator 8, the respective intersection of $V_{Error}$ and $V_{Ramp}$ is determined. By these intersections, the clock frequency at which the switching transistor 2 is controlled is determined. A higher inductor current results in a shorter on time $T_E$. Compared with a noncompensated ramp generator, whose output voltage $V_{Ramp}$ is linear, the ramp generator compensated in accordance with the invention has a shorter on time $T_E$ for all inductor currents, i.e., also for lower inductor currents. As can be seen in FIG. 3*b*, the slew rate of the output voltage of the compensated ramp generator 9 increases with increasing inductor currents (2). The inductor current increases both with increasing output current and at a constant output current with decreasing input voltage. Consequently, the loop gain of the feedback DC-DC converter 1 is reduced only at large inductor currents and low input voltages. Thus, the frequency response of the overall system can be held constant over a very wide range despite changes in input voltage and load current. In this manner, a smaller loop gain at high input voltages, and thus a loss of accuracy of the DC-DC converter, is avoided.

Figure 4:
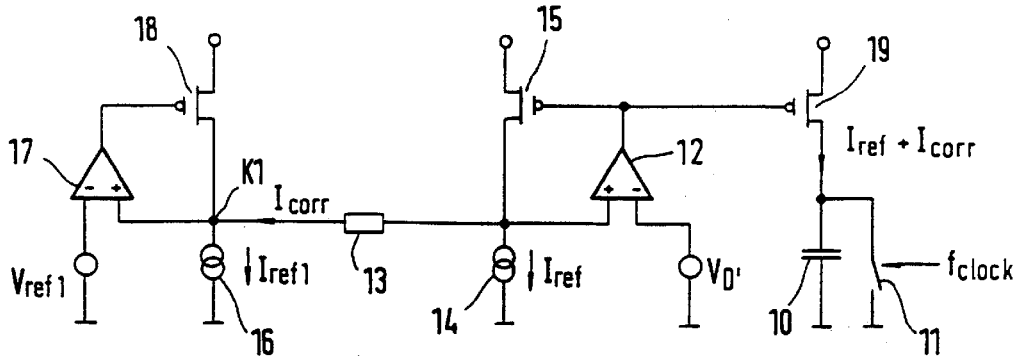
FIG. 4 is a schematic circuit diagram of one embodiment of a compensated ramp generator in accordance with the invention.

FIG. 4 illustrates one embodiment of the compensated ramp generator 9. The correction current $I_{corr}$ is generated in a first node K1 of constant potential. To this end, a first amplifier 12 is provided, whose input is connected to a voltage $V_D$ proportional to the inductor current $I_{Drossel}$. The output of the first amplifier 12 is connected through a resistor 13 to the first node K1. The first amplifier 12 is a feedback operational amplifier and may have a gain factor of one. Also provided are a first reference current source 14 in series with a first transistor 15 connected in common-source configuration, which form an output stage of the amplifier 12. Coupled to the node K1 is the output of a second operational amplifier 17. One input of the second operational amplifier 17 is connected to a second reference voltage source $V_{ref1}$, and the other input is connected to the node K1. The output stage of the second operational amplifier 17 is formed by the series combination of the second transistor 18 and a second reference current source 16. At the node K1, the sum of the correction current $I_{corr}$ and the constant reference current $I_{ref}$ is formed.

A third transistor 19, the first operational amplifier 12, and the output stage of the latter, which includes the first reference current source 14 and the first transistor 15, form a current mirror. The gate of the third transistor 19 is connected to the gate of the first transistor 15, and the drain of the third transistor 19 is connected to the capacitor 10. The first transistor 15 and the second transistor 18 have a fixed relationship to each other in terms of their electrical characteristics. Currents having a fixed relationship to each other are generated with the first and second reference current sources 14, 16. The first transistor 15 and the second transistor 18 may have the same electrical characteristics, and the first and second reference current sources 14, 16 may generate equal currents. In that case, particularly good matching of the overall system is achieved. Errors due to mismatches are avoided. The overall circuit can be implemented using monolithic integrated technology. The signal proportional to the inductor current $I_{Drossel}$ can be determined from the voltage drop across the switching transistor 2.

Figure 5:
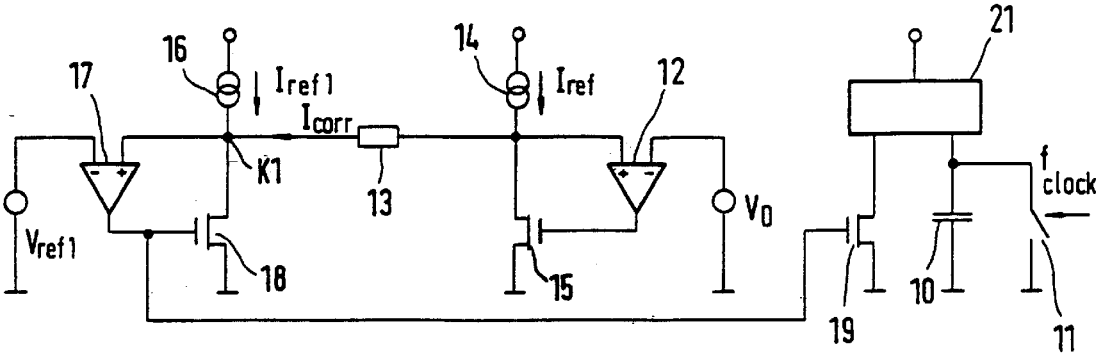
FIG. 5 is a schematic circuit diagram of another embodiment of a compensated ramp generator in accordance with the invention.

FIG. 5 illustrates another embodiment of the compensated ramp generator, where elements corresponding to those of FIG. 4 are designated by like reference characters. Unlike the embodiment of FIG. 4, the gate of the third transistor 18 is connected to the gate of the second transistor 18. The drain of the third transistor 19 is connected to the capacitor 10 through a second current mirror 21. This embodiment uses n-channel MOS transistors, whereas the embodiment shown in FIG. 4 uses p-channel MOS transistors. The second current mirror 21 causes a reversal of the potential conditions. Accordingly, in the embodiment of FIG. 5, the connections of the circuit elements to the reference voltage $V_{ref}$ and the input voltage $V_D$ are interchanged as compared to the embodiment of FIG. 4, so that, taking into account the second current mirror 21, the circuits in the two embodiments have the same control direction.

Although the present invention has been shown and described with respect to several preferred embodiments thereof, various changes, omissions and additions to the form and detail thereof, may be made therein, without departing from the spirit and scope of the invention.

What is claimed is:

1. A pulse-width-modulated DC-DC converter comprising a series combination of a switching transistor and an inductor, with the switching transistor shunted by a smoothing capacitor in series with a switching element, so that an input voltage ($V_{in}$) applied to the series combination of the switching transistor and the inductor is converted into a higher output voltage ($V_{out}$) appearing across the smoothing capacitor, an error amplifier having its first input connected to a voltage divider, to which the output voltage can be applied, and having its second input connected to a reference voltage source ($V_{ref}$), and a comparator having its first and second inputs connected, respectively, to the output of the error amplifier and to a ramp generator compensated by means of a signal proportional to the current ($I_{Drossel}$) through the inductor, and having its output coupled to the gate electrode of the switching transistor, characterized in that the compensated ramp generator is so designed that the signal proportional to the current ($I_{Drossel}$) through the inductor is superimposable on the ramp voltage such that an output voltage having a sawtooth waveform with a concave voltage rise is generable, and the ramp generator is designed so that the sum of a correction current ($I_{corr}$), which is proportional to the inductor current ($I_{Drossel}$), and a constant reference current ($I_{ref}$) is integrable in the ramp generator so that the output voltage ($V_{ramp}$) of the ramp generator rises quadratically, wherein for the generation of the correction current ($I_{corr}$), a first amplifier is provided, to whose input a voltage ($V_D$) proportional to the inductor current ($I_{Drossel}$) can be applied, and whose output is connected through a resistor to a first node (K1) of constant potential, to which the correction current ($I_{corr}$) is feedable, further characterized in that the constant node potential in the first node (K1) is generated by a second operational amplifier and a reference voltage source ($V_{ref1}$).

2. A DC-DC converter as claimed in 1, comprising a third transistor whose gate electrode is connected to the gate electrode of the first transistor, wherein the first transistor, the third transistor, and the first amplifier together forming a current mirror having its output connected to the capacitor.

3. A DC-DC converter as claimed in claim 1, wherein the gate electrode of the third transistor is connected to the gate electrode of the second transistor, and that the second transistor, the third transistor, and the second operational amplifier together form a current mirror having its output connected to the capacitor via a second current mirror.

4. A pulse-width-modulated DC-DC converter integrated circuit, comprising:

a series combination of a switching transistor and an inductor;

a smoothing capacitor in series with a switching element for shunting said switching transistor so an input voltage ($V_{in}$) applied to said series combination of said switching transistor and said inductor is converted into a higher output voltage ($V_{out}$) appearing across said smoothing capacitor;

an error amplifier having a first input connected to a voltage divider, to which said output voltage is be applied, and having a second input connected to a reference voltage source ($V_{ref}$); and a comparator having its first and second inputs connected, respectively, to the output of said error amplifier and to a ramp generator responsive to a signal proportional to current ($I_{Drossel}$) through said inductor, and having its output coupled to a gate electrode of the switching transistor, wherein said ramp generator comprises means for superimposing said signal proportional to said current ($I_{Drossel}$) through said inductor onto said ramp voltage, such that said ramp generator provides an output voltage having a sawtooth waveform with a concave voltage rise.

5. A pulse-width-modulated DC-DC converter monolithic integrated circuit, comprising:

a series combination of a switching transistor and an inductor;

a smoothing capacitor in series with a switching element for shunting said switching transistor so an input voltage ($V_{in}$) applied to said series combination of said switching transistor and said inductor is converted into a higher output voltage ($V_{out}$) appearing across said smoothing capacitor;

an error amplifier having a first input connected to a voltage divider, to which said output voltage is be applied, and having a second input connected to a reference voltage source ($V_{ref}$); and a comparator having its first and second inputs connected, respectively, to the output of said error amplifier and to a ramp generator responsive to a signal proportional to current ($I_{Drossel}$) through said inductor, and having its output coupled to a gate electrode of the switching transistor, wherein said ramp generator superimposes said signal proportional to said current ($I_{Drossel}$) through said inductor onto said ramp voltage, such that said ramp generator provides an output voltage having a sawtooth waveform with a concave voltage rise.

* * * * *